US012006937B2

(12) United States Patent
Lu et al.

(10) Patent No.: US 12,006,937 B2
(45) Date of Patent: Jun. 11, 2024

(54) FLUID PUMP WITH INTEGRATED COWLING AND DISCHARGE MUFFLER

(71) Applicant: Agilent Technologies, Inc., Santa Clara, CA (US)

(72) Inventors: Vannie Lu, Billerica, MA (US); George Galica, Worcester, MA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 17/834,875

(22) Filed: Jun. 7, 2022

(65) Prior Publication Data

US 2023/0392601 A1 Dec. 7, 2023

(51) Int. Cl.

*F04C 29/06* (2006.01)
*F04C 18/02* (2006.01)
*F04C 25/02* (2006.01)

(52) U.S. Cl.

CPC ..... *F04C 29/065* (2013.01); *F04C 18/0215* (2013.01); *F04C 25/02* (2013.01); *F04C 29/068* (2013.01); *F04C 2220/10* (2013.01); *F04C 2240/40* (2013.01); *F04C 2270/13* (2013.01)

(58) Field of Classification Search

CPC .... F04C 29/065; F04C 29/066; F04C 29/068; F04C 18/0207–0292; F04C 25/02; F04C 2220/10; F04C 2220/12; F04C 2270/13; F04C 2240/40; F04C 29/06; F04C 29/061; F04C 29/063; F04C 18/34–3568

See application file for complete search history.

(56) References Cited

U.S. PATENT DOCUMENTS

| | | | | |
|---|---|---|---|---|
| 6,186,751 | B1 | 2/2001 | Rigo | |
| 8,651,829 | B2 | 2/2014 | Lim et al. | |
| 9,341,186 | B2 | 5/2016 | Calhoun | |
| 9,429,159 | B2 | 8/2016 | Geue et al. | |
| 10,774,835 | B2 | 9/2020 | Geue et al. | |
| 2014/0161640 | A1* | 6/2014 | Geue | F04C 29/0092 417/312 |

(Continued)

FOREIGN PATENT DOCUMENTS

| | | | | |
|---|---|---|---|---|
| CN | 108468644 A | * | 8/2018 | F04C 29/068 |
| CN | 110159536 A | * | 8/2019 | |

(Continued)

OTHER PUBLICATIONS

UK Intellectual Property Office Search Report under Section 17 (5) dated Nov. 24, 2023 for Application No. GB 2308413.0; 3 pages.

*Primary Examiner* — Mark A Laurenzi
*Assistant Examiner* — Xiaoting Hu

(57) ABSTRACT

A discharge muffler for a fluid pump is formed by a cowling and a muffler insert configured to be removably inserted into a muffler receptacle of the cowling. The muffler insert includes a muffler inlet, a muffler outlet, and a plurality of muffler walls. The pump includes a pumping stage, a motor, and a drive shaft coupled between the pumping stage and the motor. When the muffler insert is inserted into the muffler receptacle, the muffler inlet communicates with the pumping stage, and the cowling and the muffler insert cooperatively define the discharge muffler. The discharge muffler is configured or effective to suppress noise generated by fluid discharged from the pumping stage.

17 Claims, 6 Drawing Sheets

(56) References Cited

U.S. PATENT DOCUMENTS

| | | | | |
|---|---|---|---|---|
| 2014/0271233 | A1* | 9/2014 | Calhoun | F04B 53/22 417/44.2 |
| 2015/0078927 | A1 | 3/2015 | Forni | |
| 2018/0335034 | A1* | 11/2018 | Geue | F04C 25/02 |

FOREIGN PATENT DOCUMENTS

| | | | | | |
|---|---|---|---|---|---|
| CN | 110410325 | A | | 11/2019 | |
| CN | 107269534 | B | | 8/2020 | |
| CN | 213711340 | U | | 7/2021 | |
| CN | 114439750 | A | * | 5/2022 | |
| KR | 20150067657 | A | * | 6/2015 | F01C 21/108 |
| WO | WO-2020254432 | A1 | * | 12/2020 | F01C 21/108 |

* cited by examiner

FLUID PUMP WITH INTEGRATED COWLING AND DISCHARGE MUFFLER

TECHNICAL FIELD

The present invention relates to fluid pumps, and particularly to fluid pumps that include a discharge muffler.

BACKGROUND

Many types of pumps generally include a pump head coupled to a prime mover by a rotating drive shaft or by two shafts coupled to each other (e.g., a prime mover shaft and a pump shaft). The pump head typically includes one or more movable pump elements that move relative to a stationary portion (a pump stator) of the pump head in a manner that pumps a working fluid (liquid or gas) from a pump inlet to a pump outlet, either for compressing or pressurizing the working fluid or for evacuating an enclosed space communicating with the pump inlet (by removing fluid from the enclosed space). The prime mover, often an electric motor, generates the power utilized for moving the movable pump elements. As an electric motor, the prime mover typically includes a motor rotor coupled to the drive shaft that rotates relative to a motor stator. The motor rotor and the motor stator typically include electrically conductive windings, electromagnets and/or permanent magnets configured to couple the motor rotor and the motor stator by a magnetic field. Electrical power supplied to the windings or magnet(s) of the motor stator or motor rotor generates a magnetic field that couples the motor stator and the motor rotor as a magnetic circuit and thereby induces rotation of the motor rotor. The drive shaft transfers the as-generated power (in particular, torque) from the motor rotor to the movable pump elements. Various types of pumps have one or more movable pump elements that require such power, such as scroll pumps, rotary vane pumps, gear pumps, screw pumps, Roots-type pumps, claw pumps, impeller pumps, fans, piston pumps, etc.

A pump often includes one or more structural enclosures that enclose the pump head and the motor. The structural enclosures may include a cowling that encloses the pump head and a motor housing that encloses the motor. The cowling (or additionally the motor housing) may cooperate with a base or tray on which the pump head (or additionally the motor) rests to fully (or substantially fully) enclose the pump head (or additionally the motor). The structural enclosures are often constructed from a plastic (e.g., polycarbonate) so as to be lightweight. The structural enclosures can serve a number of functions, such as preventing persons from touching hot surfaces and moving parts such as fans, and defining flow paths for cooling air moved by a fan.

The working fluid discharged (exhausted) from the pump head is often a significant source of noise, for example due to pulsations in the exiting fluid. To suppress this noise, a pump often includes a discharge muffler in-line with the outlet side of the pump head (i.e., in the working fluid discharge or exhaust line of the pump). The discharge muffler of previously known configurations is thus external to the pump head and increases the overall footprint of the pump. The larger footprint limits the number of available spaces that are large enough to accommodate the pump when equipped with the external discharge muffler. Moreover, a discharge muffler adds to the cost of the pump. When compared to the overall cost of the pump, particularly for small vacuum pumps as one example, the amount of cost added by providing a discharge muffler can be a significant factor.

There is an ongoing need for further developments in the field of pump design, including for providing noise suppressing features such as a discharge muffler.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

In one aspect of the present disclosure, a discharge muffler is provided for a fluid pump. The discharge muffler is configured or effective to suppress noise generated by fluid discharged from the fluid pump.

In another aspect of the present disclosure, a fluid pump includes a cowling configured to function as a discharge muffler.

According to a non-exclusive embodiment or aspect of the present disclosure, a fluid pump includes: a pump head comprising a pumping stage, wherein the pumping stage comprises a pumping stage inlet and a pumping stage outlet, and the pumping stage is configured to pump a fluid from the pumping stage inlet to the pumping stage outlet; a motor; a drive shaft coupled to the pumping stage and the motor, wherein the motor is configured to drive rotation of the drive shaft about a drive axis, and the drive shaft is configured to drive a pumping action of the pumping stage; a cowling comprising a cowling wall and a muffler receptacle, wherein the cowling wall encloses a cowling interior and at least a portion of the muffler receptacle; and a muffler insert comprising a muffler inlet, a muffler outlet, and a plurality of muffler walls, wherein the muffler insert is configured to be removably inserted into muffler receptacle. When the muffler insert is inserted into the muffler receptacle: the muffler inlet communicates with the pumping stage outlet; and the cowling wall and the muffler insert cooperatively define a discharge muffler configured to suppress noise generated by fluid discharged from the pumping stage outlet.

According to another non-exclusive embodiment, a method for operating a fluid pump includes: a providing a fluid pump according to any of the embodiments disclosed herein; operating the fluid pump, wherein the operating discharges the fluid into the discharge muffler; and flowing the fluid through the discharge muffler, wherein the discharge muffler suppresses noise generated by the fluid.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

Figure 1:
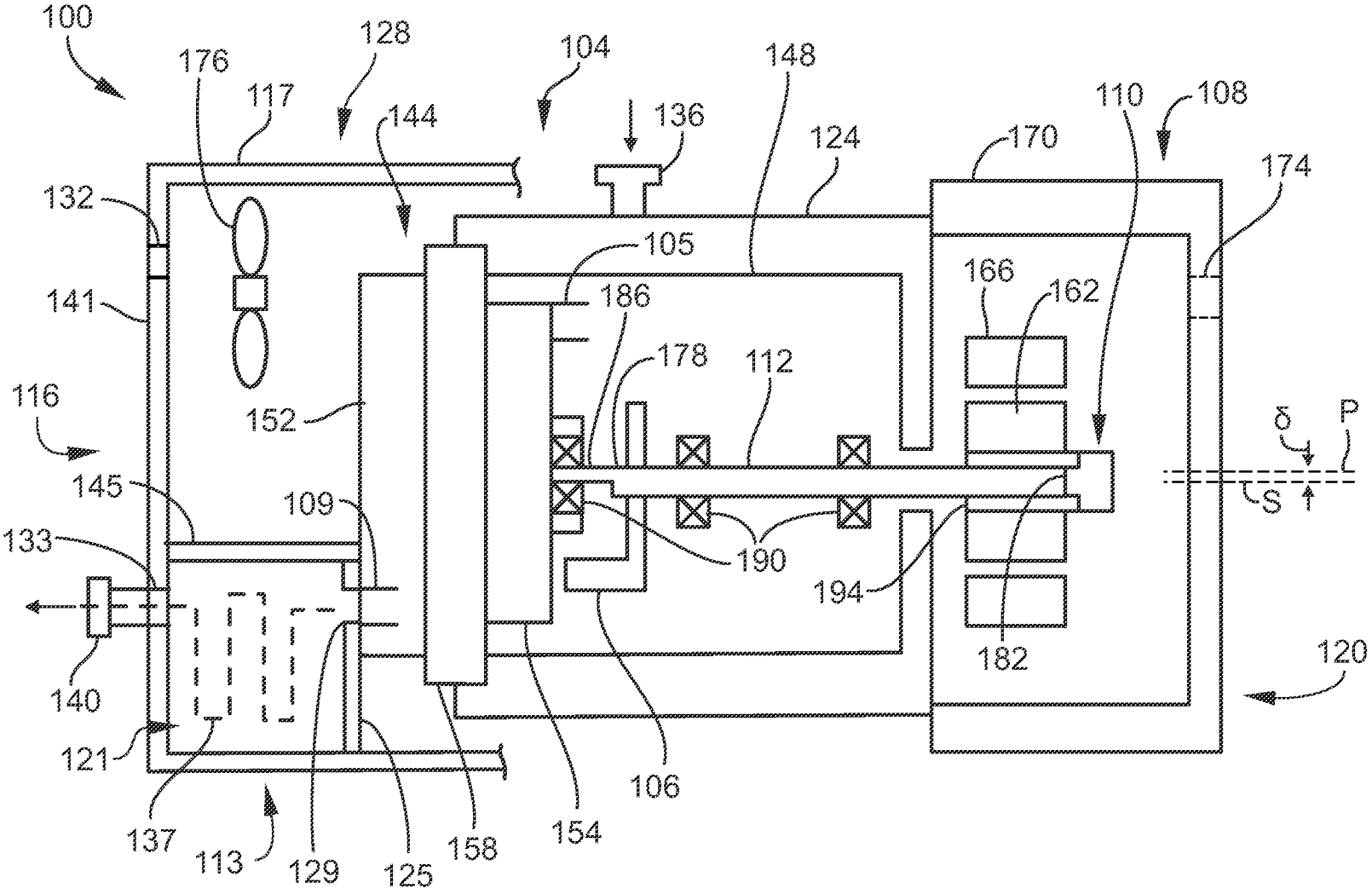
FIG. 1 is a schematic longitudinal side view of an example of a fluid pump according to an embodiment of the present disclosure.

The illustrations in all of the drawing figures are considered to be schematic, unless specifically indicated otherwise.

DETAILED DESCRIPTION

In this disclosure, all "aspects," "examples," and "embodiments" described are considered to be non-limiting and non-exclusive. Accordingly, the fact that a specific "aspect," "example," or "embodiment" is explicitly described herein does not exclude other "aspects," "examples," and "embodiments" from the scope of the present disclosure even if not explicitly described. In this disclosure, the terms "aspect," "example," and "embodiment" are used interchangeably, i.e., are considered to have interchangeable meanings.

In this disclosure, the term "substantially," "approximately," or "about," when modifying a specified numerical value, may be taken to encompass a range of values that include +/−10% of such numerical value.

FIG. 1 is a schematic view of an example of a fluid pump (or pump assembly, or pumping assembly) 100 according to an embodiment of the present disclosure. The fluid pump 100 generally includes a pump head (assembly) 104, a motor (assembly) 108, and a drive shaft 112 rotatable about a drive axis S. Depending on the embodiment, the fluid pump 100 may be configured to operate as a vacuum pump or a fluid compressor. Generally, previously known components, structures, functions, and operations of fluid pumps of the types described herein are understood by persons skilled in the art, and thus need not be described in detail herein. Accordingly, certain components of the fluid pump 100 are described only briefly herein to provide a relevant context for the presently disclosed subject matter.

For reference and description, the fluid pump 100 is considered to have a longitudinal device axis coincident with the drive axis S relative to which various components of the fluid pump 100 are positioned. The drive axis S (or device axis) is not necessarily the geometrical center axis of the fluid pump 100. In the context of the present disclosure, the terms "axial" and "axially" are considered to be relative to the drive axis S (or device axis), unless specified otherwise or the context dictates otherwise. Also for reference and description, the fluid pump 100 is considered to generally have a front end (or front side) 116 and a rear end (or rear side) 120 axially opposite to the front end 116. The pump head 104 is closer to the front end 116 than the motor 108, and the motor 108 is closer to the rear end 120 than the pump head 104. The "front" end (or front side) of any component of the fluid pump 100 is considered to be the end or side facing generally toward the front end 116. The "rear" end (or rear side) of any component of the fluid pump 100 is considered to be the end or side facing generally toward the rear end 120. From the perspective of FIG. 1, the front end 116 is on the left and the rear end 120 is on the right. However, the fluid pump 100 is not limited to any particular orientation relative to a horizontal plane (e.g., the ground or surface on which the fluid pump 100 rests) or a vertical plane, or relative to any other reference datum.

The pump head 104 may include a structural frame (or housing) 124, which may have a single-piece configuration or be an assembly of two or more frame sections. Various pump components may be attached to or integral with, and/or enclosed by, the frame 124. The pump head 104 (or the fluid pump 100) may also include an outer cowling (assembly) 128 (only partially shown in FIG. 1), which may have a single-piece configuration or be an assembly of two or more cowling sections. The cowling 128 may enclose at least part of the axial length of the pump head 104. In some embodiments, a pump base (not shown) supporting the pump head 104 may cooperate with the cowling 128 to fully enclose the pump head 104. The cowling 128 may include one or more openings as needed to accommodate one or more fluid conduits, electrical wiring, etc., one or more vents 132 for allowing air flow into or out from the interior of the pump head 104, etc.

The pump head 104 further includes a pump inlet (working fluid inlet) 136, a pump outlet (working fluid outlet) 140, and one or more pumping stages 144. The pump inlet 136 may fluidly communicate with any source of a working fluid (gas or liquid) to be pumped by the fluid pump 100. As examples, a source of working fluid may be a vacuum chamber (a chamber to be evacuated, i.e., pumped down to a sub-atmospheric pressure), a container or pipe containing a fluid to be compressed (and/or to be transported at a desired pressure and/or flow rate), or an open space containing a fluid to be compressed (e.g., ambient air). The pump inlet 136 may schematically represent one or more fluid conducting components (pipes, passages, chambers, valves, etc.) utilized to supply the working fluid to the (first) pumping stage 144. For example, the pump inlet 136 may represent one or more fluid conduits that pass through the frame 124 into an inlet region 148 of the pump head 104 that is on the inlet side of the pumping stage 144. The inlet region 148 may be a low-pressure region. The pump outlet 140 may fluidly communicate with any destination intended to receive the fluid outputted by the pump head 104, such as a container (e.g., pressure vessel) or pipe, a downstream device, a tool or system that utilizes the outputted fluid in a given process, or an open space (e.g., in a case where air or other non-toxic fluid is being evacuated from a vacuum chamber). The pump outlet 140 may schematically represent one or more fluid conducting components (pipes, passages, chambers, valves, etc.) utilized to conduct outputted fluid away from the (last) pumping stage 144. In some examples and as illustrated, the pump outlet 140 communicates with an outlet region 152 of the pump head 104 that is on the outlet side of the pumping stage 144. The outlet region 152 may be a high-pressure region. In the context of this disclosure, the terms "low-pressure" and "high-pressure" are relative to each other. That is, fluid pressure in the low-pressure region is lower than the fluid pressure in the high-pressure region, and vice versa.

The pumping stage(s) 144 include one or more movable pump elements 154 that move relative to one or more stationary pump components, or pump stators 158. Generally, the pumping stage(s) 144 are configured to pump the working fluid from the pump inlet 136 to the pump outlet 140 in response to movement of the movable pump element(s) 154. The movable pump element(s) 154 cooperate with the pump stator(s) 158 to perform work on the working fluid. The movable pump element(s) 154 and the pump stator(s) 158 cooperatively define one or more fluid flow paths through which the working fluid is conducted (pumped) through the pumping stage(s) 144, as appreciated by persons skilled in the art. In the illustrated example, the pump head 104 includes a single pumping stage 144 (i.e., with a single movable pump element 154).

Depending on the type of movable pump element 154, its movement may involve any combination of orbiting, rotation, and/or linear translation in any or all of six degrees of freedom. Examples of the movable pump element 154 include, but are not limited to, an orbiting scroll, a rotary vane component, a crank, a cam, a gear, a screw, a Roots rotor (e.g., lobe), a claw, an impeller, a compressor wheel, a fan, and a piston, all of which are generally understood by persons skilled in the art.

Generally, the pump stator 158 may be any stationary portion of the pump head 104 configured to interface with the movable pump element 154 to generate a pumping action on the working fluid. In the present example, the pump stator 158 is attached to, or is an integral part of, the frame 124.

In an example, the pumping stage 144 is considered to include a pumping stage inlet 105 and a pumping stage outlet 109. Hence, the pumping stage 144 is configured to pump the working fluid from the pumping stage inlet 105 to the pumping stage outlet 109. The pumping stage inlet 105 may fluidly communicate with the pump inlet 136 via an intermediate structure, such as the structure defining the inlet region 148. The outlet side of the pumping stage 144 may fluidly communicate with the pumping stage outlet 109 via an intermediate structure, such as the structure defining the outlet region 152. As non-exclusive examples, the pumping stage inlet 105 may be one or more inlet ports of the movable pump element 154, and the pumping stage outlet 109 may be one or more outlet ports of the pump stator 158 (or of the outlet region 152, if provided).

Generally, the motor 108 is configured to generate rotational power and transfer it to the drive shaft 112, which in turn transfers the power to the movable pump element 154 via an appropriate mechanical interface that either rotates the movable pump element 154 directly about the drive axis S or converts the shaft rotation into another type of movement (e.g., orbiting, linear translation, etc.). For this purpose, the motor 108 may be any type of motor suitable for powering a pump head 104 of the types described herein. In a typical example and as illustrated, the motor 108 is an electric motor that includes one or more components communicating with a suitable electrical power input. In a typical example, the motor 108 is a direct-current (DC) brushless motor, but alternatively may be a DC brushed motor or an appropriate type of alternating-current (AC) motor.

In the illustrated example, the motor 108 includes a motor rotor 162, a motor stator 166, and a motor housing 170 enclosing the motor rotor 162 and motor stator 166. The motor rotor 162 is coupled to the drive shaft 112 in a manner described below. The motor rotor 162 and the motor stator 166 each may have a single-piece configuration or may include separate portions attached to or spaced from each other. Depending on the configuration, the motor rotor 162 and the motor stator 166 include electrically conductive windings, electromagnets, and/or permanent magnets as needed to magnetically couple the motor rotor 162 and the motor stator 166 with a magnetic field. The magnetic field is oriented such that in response to an input of electrical power to the motor rotor 162 or the motor stator 166 (depending on the configuration), the motor rotor 162 rotates about the drive axis S and thereby rotates the drive shaft 112 about the drive axis S. The motor stator 166 typically concentrically surrounds the motor rotor 162 and is spaced from the motor rotor 162 by a radial (and annular) gap (the term "radial" referring to a direction orthogonal to the drive axis S). A cylindrical shield (not shown) composed of an electrically insulating and non-magnetic material (e.g., a suitable plastic) may be positioned in the radial gap to protect the motor stator 166 from contaminants (dust, metal particles, other particulates, oil, etc.) that may be present in the vicinity of the drive shaft 112. The motor housing 170 may include one or more openings as needed to accommodate one or more fluid conduits, electrical wiring, etc., one or more vents 174 for allowing air flow into or out from the interior of the pump head 104, etc. In some examples, the motor housing 170 may be attached to or engaged with the cowling 128, or may be considered as being part of the cowling 128.

In some embodiments, the fluid pump 100 may include additional structures (not shown) that enclose one or more of the components of the pump head 104 and/or the motor 108 in a hermetically sealed manner, as appreciated by persons skilled in the art.

The drive shaft 112 is axially elongated along the drive axis S between a front shaft end 178 and an axially opposing rear shaft end 182 of the drive shaft 112. The front shaft end 178 is coupled to the movable pump element 154, either directly or via an interface appropriate for the embodiment. The rear shaft end 182 is coupled to the motor rotor 162 in a manner described below. The drive shaft 112 may have a single-piece configuration as illustrated, or may be an assembly of two or more shafts. For example, the drive shaft 112 may include a pump head shaft coupled to the movable pump element 154, a motor shaft coupled to the motor rotor 162, and a shaft coupling that couples together the pump head shaft and the motor shaft in a contacting manner (e.g., a mechanical coupling) or a non-contacting manner (e.g., an axial or radial magnetic coupling).

In some embodiments and as illustrated, the movable pump element 154 is not a pump "rotor" in the sense of rotating directly on the drive axis S, but instead is an orbiting pump element such as, for example, an orbiting scroll or a rotary vane-holding element, as appreciated by persons skilled in the art. That is, instead of rotating directly on the drive axis S, the movable pump element 154 is configured to orbit at a radial offset distance around the drive axis S. In this case, the drive shaft 112 at its front shaft end 178 may include (may be integral with or coupled to) an eccentric member (or crank) 186 that is coupled to the movable pump element 154. In FIG. 1, the eccentricity is shown by a central axis P of the movable pump element 154 (and of the eccentric member 186) being radially offset from the drive axis S by an offset distance 6. A non-limiting example of an orbiting pump element in the context of a scroll pump is described further below in conjunction with FIGS. 4 and 5.

The fluid pump 100 typically includes a plurality of bearings located along different axial positions that are configured to support the rotation of the drive shaft 112 or the motion of the movable pump element 154, and/or configured to bear axial (e.g., thrust) forces generated during operation of the fluid pump 100. Such bearings may have any configuration appropriate for their function such as, for example, roller bearings, thrust bearings, bushings, etc. In the illustrated example, the fluid pump 100 includes a number of pump-side bearings 190 and at least one motor-side bearing 194, all of which are attached to (e.g., by press-fitting) the drive shaft 112. In the present example, the motor-side bearing 194 is a cylindrical or sleeve-type bushing.

In some embodiments, the fluid pump 100 may generate forces during operation that may cause force imbalances, which may cause instabilities during operation such as excessive vibration, shaking, etc., of one or more components of the fluid pump 100. Such imbalances may thus lead to premature wear or failure of one or more components of the fluid pump 100, loosening of fasteners, detachment or delamination of components, etc. In particular, orbiting pump components can generate force imbalances. The bearings provided with a pump (e.g., bearings 190 and 194) are not designed to address the problem of force imbalance. In some embodiments and as illustrated, the fluid pump 100 includes one or more rotatable counterweights 106 configured to (fully or partially) counterbalance the imbalance during operation. The counterweight 106 is attached to (e.g., by press-fitting), and hence rotates with, the drive shaft 112. Typically, the counterweight 106 (or at least one of the counterweights 106 provided) is positioned in the pump head 104 near the movable pump element 154, as illustrated.

In the present embodiment, fluid pump 100 further includes a connector (assembly) 110 that is configured to couple the motor rotor 162 and the drive shaft 112 at the rear shaft end 182. Hence, the connector 110 is rotatable about the drive axis S together with the drive shaft 112 and the motor rotor 162. In some embodiments, the connector 110 is coupled to the motor rotor 162 indirectly, through being engaged with the illustrated motor-side bearing 194.

In some embodiments, the fluid pump 100 further includes a cooling system configured to carry heat energy away from the pump head 104 and/or the motor 108. For example, the cooling system may include one or more fans 176, one or more internal air passages, and one or more vents (e.g., vent(s) 132) serving as inlets or outlets. One or more fans 176 are positioned in one or more appropriate locations for establishing one or more flow paths for drawing ambient air into the fluid pump 100, routing the air to pick up and carry heat energy away from the pump head 104 and/or the motor 108, and exhausting the heated air from the fluid pump 100. In the illustrated example, the fan 176 is mounted in an interior region of the cowling 128, and includes its own motor for driving its fan blades. Alternatively, the fan 176 (or an additional fan 176) may be located on the rear (inlet) side of the pumping stage 144, and may be coupled to and thus powered by the drive shaft 112. An additional fan (not shown) may be mounted in the interior of the motor housing 170. In addition, the cooling system may include cooling fins (not shown) provided on various internal and/or external surfaces of the fluid pump 100.

According to an aspect of the present disclosure, the fluid pump 100 includes an insertable discharge muffler (or exhaust muffler) 113 positioned at the front side 116 of the fluid pump 100 between the pumping stage 144 and the pump outlet 140. The discharge muffler 113 is configured to suppress noise generated by the working fluid being discharged from the pumping stage outlet 109 during operation of the fluid pump 100. In the illustrated example, the cowling 128 includes a cowling wall 117 and a muffler receptacle 121. The cowling wall 117 is configured such that it encloses a cowling interior and at least a portion of the muffler receptacle 121. The discharge muffler 113 includes a muffler insert 125 configured to be removably inserted into muffler receptacle 121, such as during assembly of the cowling 128. Accordingly, the muffler insert 125 may be removed from the muffler receptacle 121, and re-inserted into the muffler receptacle 121 at a later time (e.g., after cleaning the muffler insert 125). Alternatively, the muffler insert 125 may be removed from the muffler receptacle 121 and replaced with a new muffler insert 125, which may have either the same configuration as the previously installed muffler insert 125 or a different configuration. For example, the previously installed muffler insert 125 and the new muffler insert 125 may be configured to preferentially suppress different sound frequencies. In all such cases, after inserting the muffler insert 125 into the muffler receptacle 121, the discharge muffler 113 is fully formed or assembled. Stated differently, the cowling wall 117 and the muffler insert 125 cooperatively define the discharge muffler 113.

As another alternative, the cowling 128 of the present example may be replaced with a differently configured cowling, namely a cowling that does not function as a muffler and hence does not include or utilize the muffler insert 125. Such a cowling may be assembled to the fluid pump 100 in applications that do not require a muffler. Accordingly, the cowling 128, or the arrangement of the cowling wall 117 and muffler insert 125, provides flexibility in the configuration of the fluid pump 100, because the fluid pump 100 may or may not include or utilize the discharge muffler 113 depending on the application.

Figure 2:
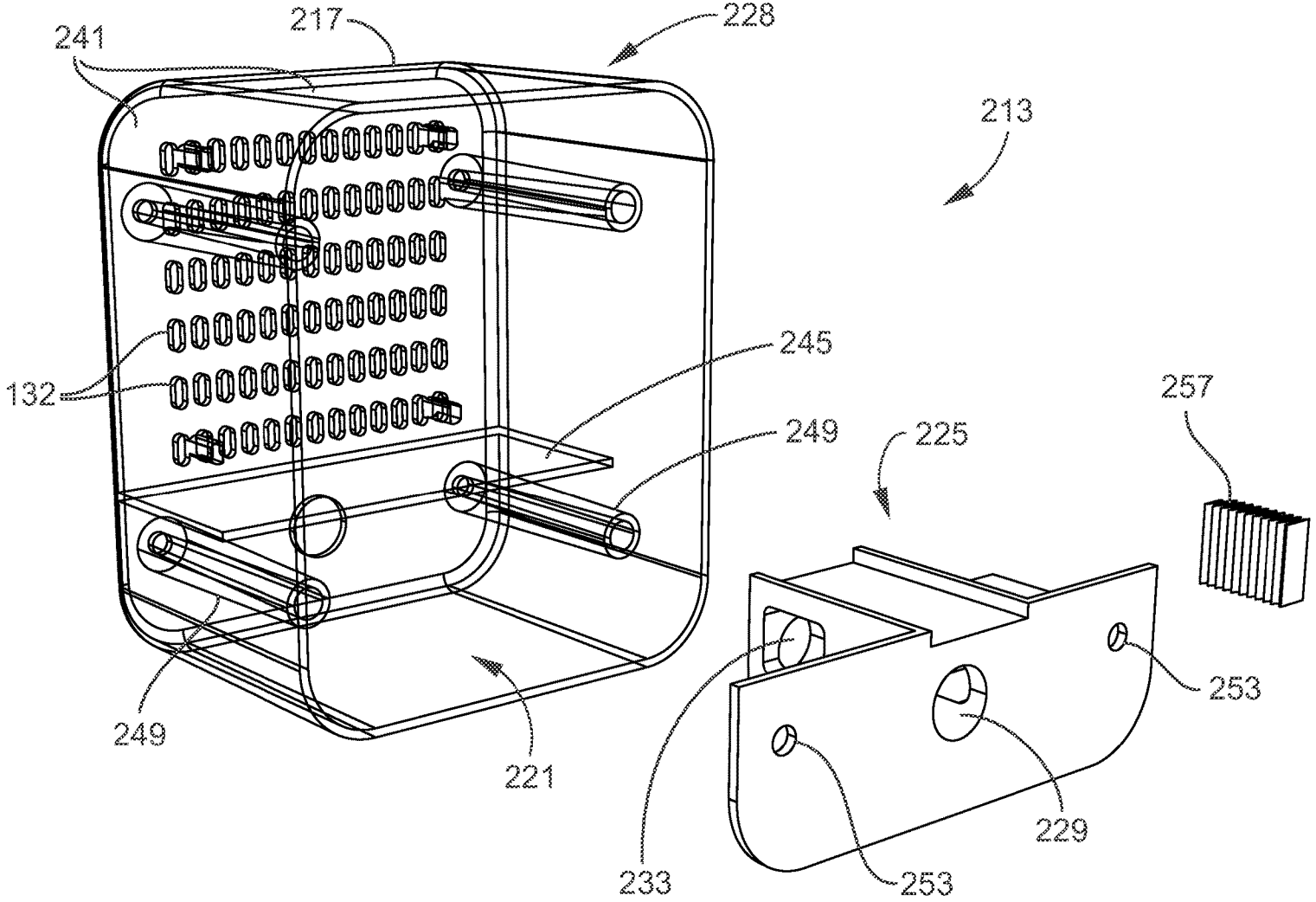
FIG. 2 is an exploded, perspective view of an example of a discharge muffler according to an embodiment of the present disclosure.
Figure 3A:
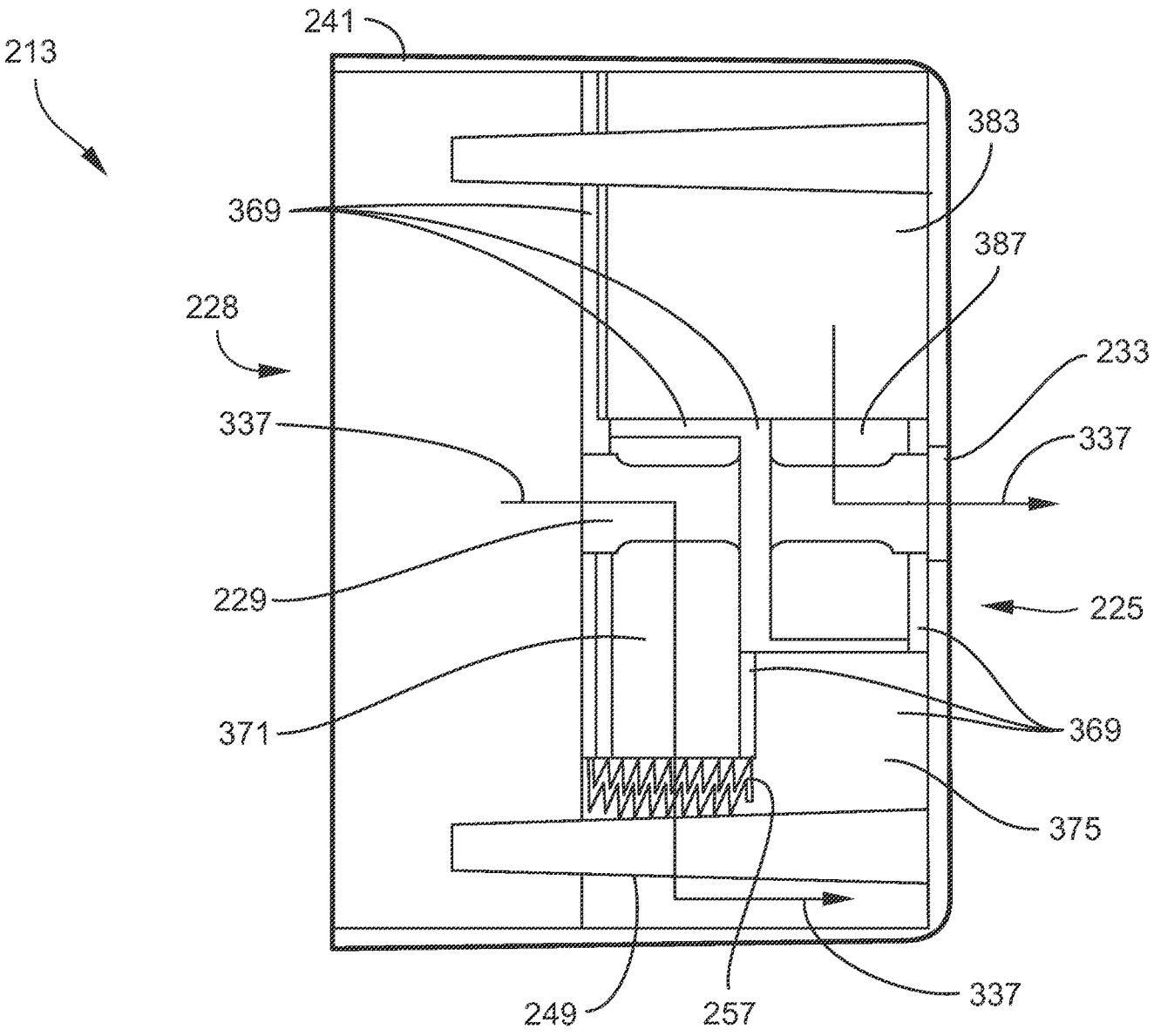
FIG. 3A is a cross-sectional top plan view of the discharge muffler illustrated in FIG. 2 in assembled form, showing passages and flow paths for discharge fluid.
Figure 3B:
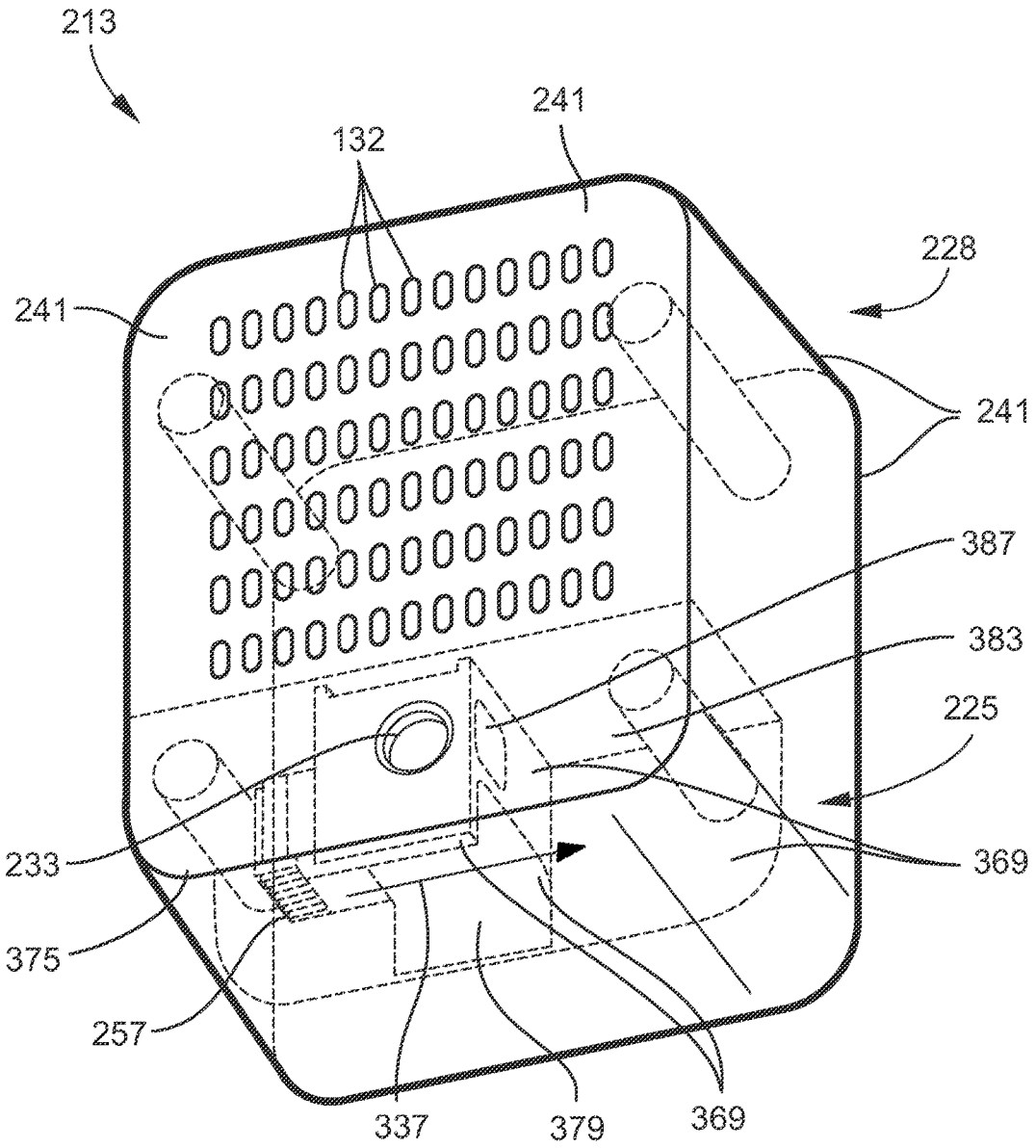
FIG. 3B is a perspective view of the discharge muffler illustrated in FIG. 2 in assembled form, as seen for example from outside a fluid pump to which the discharge muffler may be mounted, showing passages and flow paths for discharge fluid.

In the present example, the muffler insert 125 includes a muffler inlet 129, a muffler outlet 133, and a plurality of muffler walls (not shown, but see FIGS. 2-3B). When the muffler insert 125 is inserted into muffler receptacle 121, the muffler inlet 129 fluidly communicates with the pumping stage outlet 109. The pump outlet 140 may be attached to the muffler outlet 133. Also in the present example, when the muffler insert 125 is inserted into the muffler receptacle 121, the cowling wall 117 and the muffler insert 125 (in particular, the plurality of muffler walls) cooperatively define a plurality of muffler passages (not shown, but see FIGS. 2-3B), and a discharge fluid flow path 137 running from the pumping stage outlet 109, through the muffler inlet 129, through the muffler passages, and to the muffler outlet 133. As indicated by the dashed-line arrow depicting the discharge fluid flow path 137, the discharge fluid flow path 137 is a multi-turn flow path. That is, the discharge fluid flow path 137 includes a plurality of turns (changes in direction). The turns are arranged such that before the discharge fluid enters each of the muffler passages, the discharge fluid impacts the cowling wall 117 and/or one or more of the muffler walls (depending on the location of the turn in the discharge fluid flow path 137).

In an example, the muffler insert 125 further includes one or more filters (not shown, but see FIGS. 2-3B) configured to filter out particulates from the fluid discharged from the pumping stage outlet 109. The material of the filter may have any composition and porosity effective for blocking the types of particulates expected to be present in the discharge fluid without excessively restricting fluid flow. As one non-exclusive example, the filter may be composed of paper. The filter is positioned at a point along the discharge fluid flow path 137, such as near the muffler inlet 129. The filter is typically disposable and replaceable, i.e. the filter is a consumable.

In the illustrated example, the cowling wall 117 includes an outside cowling wall 141 (a single-piece wall or one or more walls) and an inside cowling wall 145. The outside cowling wall 141 and the cowling inside wall 145 form physical boundaries of the inserted (or installed) discharge muffler 113, i.e., after the muffler insert 125 has been inserted into the muffler receptacle 121. The outside cowling wall 141 and the inside cowling wall 145 are configured such that the outside cowling wall 141 defines at least two cowling interior sections that are at least partially partitioned by the inside cowling wall 145, with one cowling interior section corresponding to the muffler receptacle 121 and the other cowling interior section corresponding to the rest of the cowling interior.

Generally, no limitation is placed on the material composition of the cowling wall 117 and the muffler insert 125. In one aspect of the present disclosure, the muffler insert 125, or both the muffler insert 125 and the cowling wall 117, are composed of a plastic. In an example, the plastic is a lightweight and low-cost plastic relative to other materials such as metals and metal alloys utilized to manufacture conventional mufflers. Such a plastic may be utilized in a low-cost fabrication process such as injection molding, in comparison to materials that require higher-cost machining and assembly processes to manufacture conventional mufflers.

FIGS. 2-3B illustrate an example of a discharge muffler 213 according to an embodiment or aspect of the present disclosure. Specifically, FIG. 2 is an exploded, perspective view of the discharge muffler 213, FIG. 3A is a cross-sectional view of the discharge muffler 213 in assembled form, and FIG. 3B is a perspective view of the discharge muffler 213 in assembled form. Alternatively, FIGS. 2-3B may be considered as illustrating a cowling assembly that includes a cowling 228 and a muffler insert 225, which combine (are assembled) to form the discharge muffler 213. The discharge muffler 213 may be provided with any of the fluid pumps described herein.

In the present embodiment, as best shown in FIG. 2, the cowling 228 includes a cowling wall 217. The cowling wall 217 includes one or more outside cowling walls 241 and an inside cowling wall 245, which cooperatively at least partially define a muffler receptacle 221 as described above. Generally, after inserting the muffler insert 225 into the muffler receptacle 221, the muffler insert 225 may be secured in a fixed position by any appropriate means. In the illustrated example, the cowling 228 includes one or more mounting posts 249 that each have an internal thread. When the muffler insert 225 is inserted into the muffler receptacle 221, one or more mounting holes 253 of the muffler insert 225 are aligned with one or more corresponding mounting posts 249, thereby allowing a screw or screws to be inserted through the mounting hole(s) 253 and threaded into the mounting post(s) 249. FIG. 2 also shows a replaceable filter 257 that can be installed in the discharge muffler 213, as described above.

In the present embodiment, the muffler insert 225 includes a muffler inlet 229 and a muffler outlet 233. As best shown in FIGS. 3A and 3B, the muffler insert 225 also includes a plurality of muffler walls, some of which are designated as 369. The cowling wall 217 and the muffler walls 369 cooperatively define a plurality of muffler passages between the muffler inlet 229 and the muffler outlet 233, and accordingly define a discharge fluid flow path 337 indicated by a series of arrows in FIGS. 3A and 3B. The muffler passages may be of any number and configuration (size, shape, etc.), as needed to effectively suppress the noise generated by the discharge fluid entering the discharge muffler 213 (or suppress at least the sound frequency or frequencies making the most contribution to the noise). In the present example, the muffler passages are considered to be an alternating series of muffler tunnels and muffler chambers. Specifically, the discharge fluid flow path 337 runs as follows (from the pumping stage outlet 109, FIG. 1): through the muffler inlet 229, through the muffler passages, and to and through the muffler outlet 233. In this example, the muffler passages include, in order of fluid flow, a first muffler tunnel 371, a first muffler chamber 375, a second muffler tunnel 379, a second muffler chamber 383 (FIG. 3B), and a third muffler tunnel 387. Also in this example, the filter 257 is mounted at the interface of the first muffler tunnel 371 and the first muffler chamber 375, but the filter 257 could be mounted at another location along the discharge fluid flow path 337.

Figure 4:
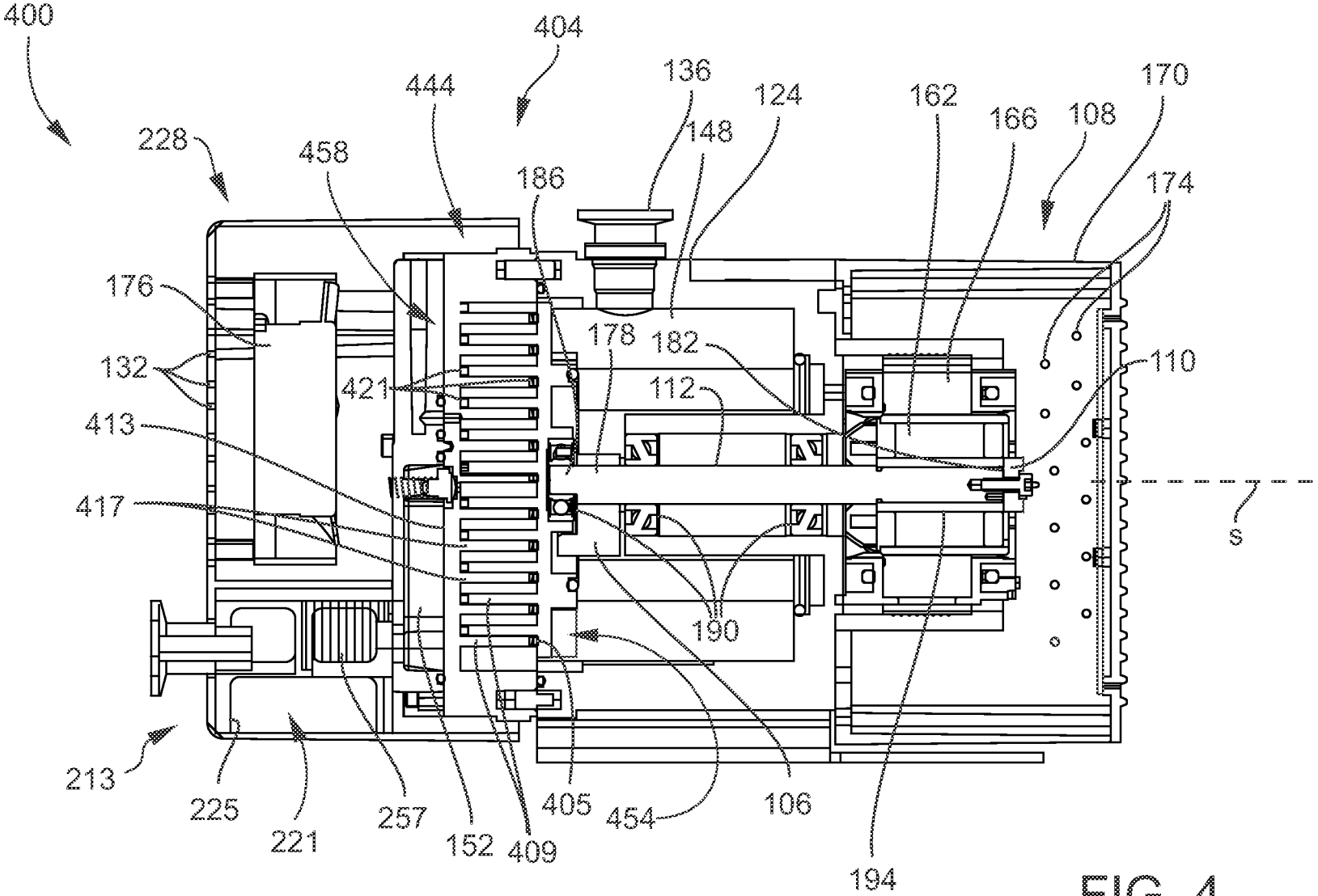
FIG. 4 is a cross-sectional, longitudinal side view of an example of a fluid pump configured as a scroll pump, according to another embodiment of the present disclosure.

FIG. 4 is a cross-sectional, longitudinal side view of an example of a scroll pump 400 according to another embodiment. The scroll pump 400 may be configured as a vacuum pump or a compressor. The scroll pump 400 includes a discharge muffler as described herein, such as the discharge muffler 213 described above and illustrated in FIGS. 2-3B.

The scroll pump 400 further includes a pump head 404 with a pumping stage 444 in which the movable pump element is in the form of an orbiting plate scroll 454 and the pump stator is in the form of stationary plate scroll 458. The orbiting plate scroll 454 orbits around the drive axis S relative to the stationary plate scroll 458 in the manner described above. Specifically, the orbiting plate scroll 454 includes an orbiting plate 405 that orbits in the transverse plane (orthogonal to the drive axis S as described above). The orbiting plate scroll 454 further includes an orbiting scroll blade 409 that extends (or projects) axially in the direction from the orbiting plate 405 toward the stationary plate scroll 458. The stationary plate scroll 458 includes a stationary plate 413, and a stationary scroll blade 417 that extends (or projects) axially in the direction from the stationary plate 413 toward the orbiting plate scroll 454.

The orbiting scroll blade 409 and the stationary scroll blade 417 are shaped as spirals (i.e., run along a spiral path) in the transverse plane, as appreciated by persons skilled in the art. The cross-sectional view of FIG. 4 shows the several turns or wraps of the spiral-shaped orbiting scroll blade 409 and stationary scroll blade 417. As illustrated, the orbiting scroll blade 409 is juxtaposed with the stationary scroll blade 417 in the radial direction (relative to the drive axis S or device axis), such that the orbiting scroll blade 409 and the stationary scroll blade 417 are nested together with a clearance and a predetermined relative angular positioning. By this configuration, one or more pockets are defined in the pumping stage 444 by (and between) the nested orbiting scroll blade 409 and stationary scroll blade 417. The volume(s) of the pocket(s) vary as the orbiting scroll blade 409 orbits relative to the stationary scroll blade 417. Consequently, the working fluid is drawn into the pump inlet 136, through the pumping stage(s) 444, and to the pump outlet 140. In the pumping stage(s) 444, the working fluid is compressed in and by the pocket(s) as their volume(s) are reduced during one or more portions of the orbiting cycle of the orbiting plate scroll 454.

The axial tips of the orbiting scroll blade 409 and the stationary scroll blade 417 each may include a groove 525 (FIG. 5) in which a tip seal 421 is seated. Thus, the tip seal 421 runs along the same spiral path as the orbiting scroll blade 409 or the stationary scroll blade 417. The tip seal 421 of the orbiting plate scroll 454 is positioned between the orbiting scroll blade 409 and the stationary plate 413, and contacts the stationary plate 413 to thereby create an axial seal between the orbiting scroll blade 409 and the stationary plate 413. The tip seal 421 of the stationary plate scroll 458 is positioned between the stationary scroll blade 417 and the orbiting plate 405, and contacts the orbiting plate 405 to thereby create an axial seal between the stationary scroll blade 417 and the orbiting plate 405. The tip seals 421 are typically composed of a plastic.

The orbiting plate scroll 454 is an example of a pump component that creates a force imbalance during operation due to its orbiting motion. In the present example, this may be addressed by providing a counterweight 106 that is mounted to, and thus rotates with, the drive shaft 112 as described above.

Figure 5:
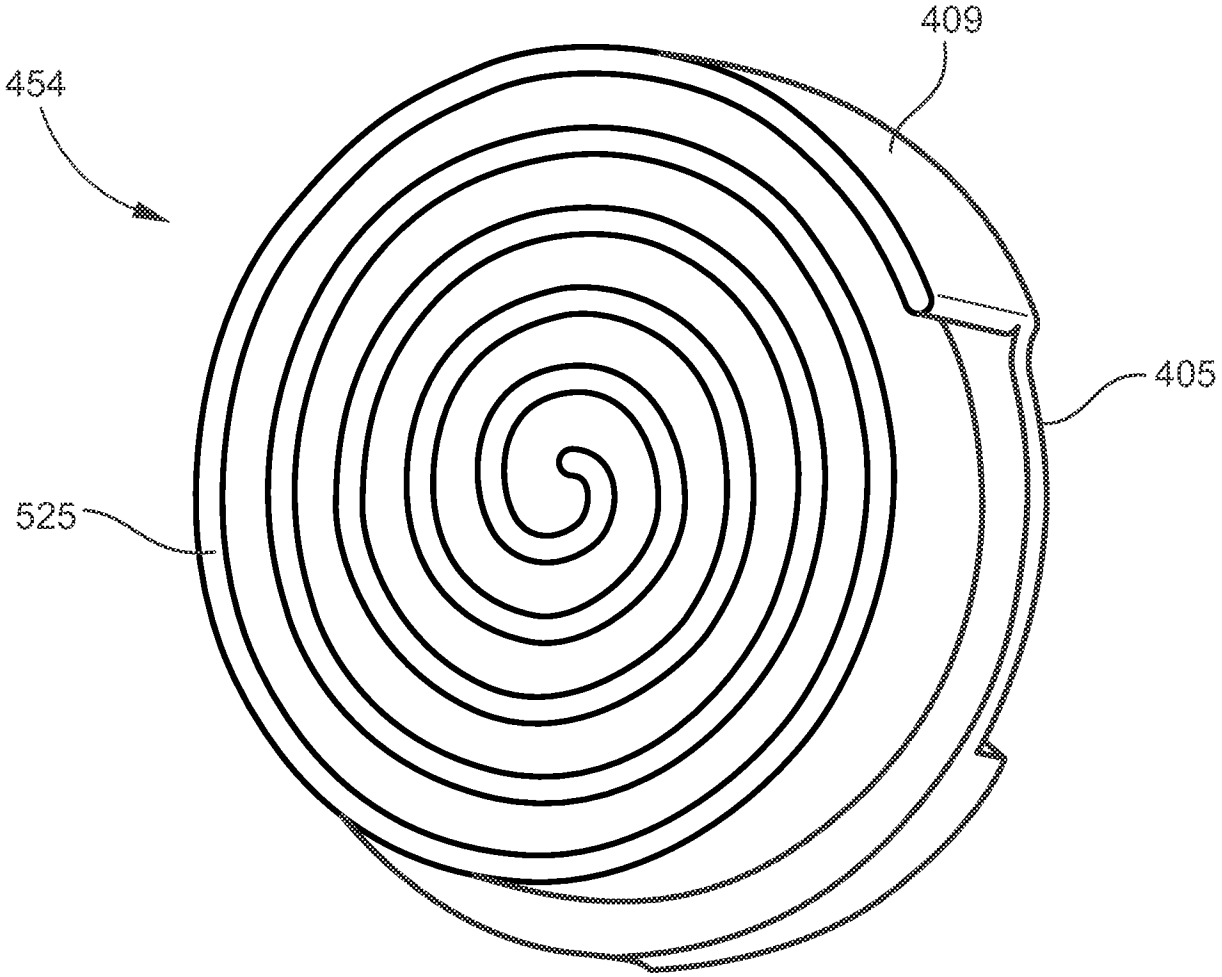
FIG. 5 is a perspective view of an example of an orbiting plate scroll that may be provided in the scroll pump illustrated in FIG. 4, according to an embodiment of the present disclosure.

FIG. 5 is a perspective view of an example of the orbiting plate scroll 454. In particular, FIG. 5 shows the spiral shape of the orbiting scroll blade 409. The spiral shape of the stationary scroll blade 417 may be the same or similar. FIG. 5 also shows the spiral groove 525 formed at the tip of the orbiting scroll blade 409, in which the tip seal 421 is seated as described above.

Scroll pumps are further described in, for example, U.S. Pat. No. 9,341,186 and U.S. Patent Application Pub. No. 2015/0078927, the entire contents of each of which are incorporated by reference herein.

It will be understood that terms such as "communicate with" and "in . . . communication with" (for example, a first component "communicates with" or "is in communication with" a second component), as well as "coupled to" or "coupled with," are used herein to indicate a structural, functional, mechanical, electrical, signal, optical, magnetic, electromagnetic, ionic or fluidic relationship between two or more components or elements. As such, the fact that one component is said to communicate with or be coupled to/with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A fluid pump, comprising:

a pump head comprising a pump housing and a pumping stage, wherein the pumping stage comprises a pumping stage inlet, a pumping stage outlet, a pump stator positioned inside the pump housing, and a movable pump element positioned inside the pump housing, wherein the movable pump element is configured to be driven by a motor to drive a pumping action of the pumping stage, such that the pumping stage pumps a fluid from the pumping stage inlet to the pumping stage outlet;

a cowling removably mountable to the pump head and separate from the pump housing, the cowling comprising a cowling wall and a muffler receptacle, wherein the cowling wall encloses a cowling interior and at least a portion of the muffler receptacle, and the cowling wall and the muffler receptacle are positioned outside the pump housing, and wherein:

the cowling wall comprises an outside cowling wall and an inside cowling wall arranged to form at least a first cowling interior section and a second cowling interior section at least partially partitioned by the inside cowling wall, and the first cowling interior section corresponds to the muffler receptacle; and the outside cowling wall comprises a vent communicating with an environment outside the cowling and configured to establish an air flow path between the second cowling interior section and the environment via the vent; and a muffler insert comprising a muffler inlet, a muffler outlet, and a plurality of muffler walls, wherein the muffler insert is configured to be removably inserted into the muffler receptacle and is removable from the muffler receptacle without disassembling the pump head, wherein, when the muffler insert is inserted into the muffler receptacle, the cowling wall and the muffler insert cooperatively define an assembled discharge muffler positioned outside the pump housing and configured to suppress noise generated by fluid discharged from the pumping stage outlet.

2. The fluid pump of claim 1, wherein, when the muffler insert is inserted into the muffler receptacle, the cowling wall and the plurality of muffler walls cooperatively define a plurality of muffler passages, and a discharge fluid flow path running from the pumping stage outlet, through the muffler inlet, through the muffler passages, and to the muffler outlet.

3. The fluid pump of claim 2, wherein, when the muffler insert is inserted into the muffler receptacle, the discharge fluid flow path comprises a plurality of turns arranged such that before the fluid enters each of the muffler passages, the fluid impacts one or more of the muffler walls and/or the cowling wall.

4. The fluid pump of claim 1, wherein the muffler insert comprises a filter configured to filter out particulates from the fluid discharged from the pumping stage outlet.

5. The fluid pump of claim 1, wherein the muffler insert, or both the muffler insert and the cowling wall, are composed of a plastic.

6. The fluid pump of claim 1, wherein the movable pump element comprises an orbiting pump element configured to move in an orbiting manner around a drive axis in response to rotation of a drive shaft.

7. The fluid pump of claim 1, wherein:

the movable pump element comprises an orbiting scroll blade;

the pump stator comprises a stationary scroll blade nested with the orbiting scroll blade; and the orbiting scroll blade is configured to move in an orbiting manner relative to the stationary scroll blade in response to rotation of a drive shaft, to create at least one moving or variable-volume pocket between the orbiting scroll blade and the stationary scroll blade effective to pump fluid.

8. The fluid pump of claim 1, wherein the movable pump element comprises a pump rotor configured to rotate about a drive axis of a drive shaft.

9. A method for operating a fluid pump, the method comprising:

providing the fluid pump according to claim 1;

operating the fluid pump, wherein the operating discharges the fluid into the discharge muffler; and flowing the fluid through the discharge muffler, wherein the discharge muffler suppresses noise generated by the fluid.

10. The method of claim 9, wherein the flowing comprises flowing the fluid along a discharge fluid flow path running from the pumping stage outlet, through the muffler inlet, through a plurality of muffler passages cooperatively defined by the cowling wall and the plurality of muffler walls, and to the muffler outlet.

11. The method of claim 10, wherein the discharge fluid flow path comprises a plurality of turns arranged such that before the fluid enters each of the muffler passages, the fluid impacts one or more of the muffler walls and/or the cowling wall.

12. The method of claim 9, comprising, before operating the fluid pump, mounting the cowling with the muffler insert inserted therein to the pump head.

13. The method of claim 9, comprising, after operating the fluid pump, replacing the cowling with a different cowling that does not include the muffler insert.

14. The method of claim 9, comprising inserting the muffler insert into the muffler receptacle.

15. The method of claim 9, comprising replacing the muffler insert with a new muffler insert having the same configuration as, or different configuration from, the replaced muffler insert.

16. The fluid pump of claim 1, comprising a fan positioned at or in the second cowling interior section and configured to establish an air flow between the second cowling interior section and the environment via the vent.

17. The fluid pump of claim 1, wherein:

the pump head comprises an outlet region defining a fluid flow path from an outlet side of the pumping stage to the pumping stage outlet;

the pumping stage is configured to pump the fluid from the pumping stage inlet to the outlet side of the pumping stage, through the outlet region, and to the pumping stage outlet;

the cowling is separate from the outlet region, and the cowling wall and the muffler receptacle are positioned outside the outlet region; and when the muffler insert is inserted into the muffler receptacle, the assembled discharge muffler is positioned outside the outlet region.

* * * * *